US008561550B2

(12) United States Patent
Raml

(10) Patent No.: US 8,561,550 B2
(45) Date of Patent: Oct. 22, 2013

(54) DECK LEDGE TABLE

(76) Inventor: Joseph P. Raml, Sheboygan, WI (US)

( * ) Notice: Subject to any disclaimer, the term of this patent is extended or adjusted under 35 U.S.C. 154(b) by 0 days.

(21) Appl. No.: 13/589,572

(22) Filed: Aug. 20, 2012

(65) Prior Publication Data

US 2013/0042794 A1 Feb. 21, 2013

Related U.S. Application Data

(60) Provisional application No. 61/524,837, filed on Aug. 18, 2011.

(51) Int. Cl.
*A47B 37/00* (2006.01)

(52) U.S. Cl.
USPC ..... 108/42; 108/152

(58) Field of Classification Search
USPC ..... 108/42, 152, 40, 48; 211/90, 90.01, 211/87.01, 86.01, 88.01, 90.02; 248/245, 248/235, 240, 241, 205.1, 238; 24/525, 569
See application file for complete search history.

(56) References Cited

U.S. PATENT DOCUMENTS

| | | | | |
|---|---|---|---|---|
| 4,708,309 | A | 11/1987 | Walter | |
| 4,889,057 | A * | 12/1989 | Chartrand | 108/42 |
| 5,240,214 | A * | 8/1993 | Birnbaum et al. | 248/231.41 |
| 5,528,993 | A | 6/1996 | Vincelli | |
| 5,535,973 | A | 7/1996 | Bailey et al. | |
| D376,708 | S * | 12/1996 | Robertson et al. | D6/429 |
| 5,653,178 | A * | 8/1997 | Huczka | 108/47 |
| 5,685,517 | A * | 11/1997 | Salibra | 248/519 |
| 5,895,017 | A * | 4/1999 | McMillan, Jr. | 248/188.1 |
| 6,059,300 | A | 5/2000 | Wu | |
| 6,079,336 | A * | 6/2000 | Lindstrom | 108/42 |
| 6,082,270 | A | 7/2000 | Zerger | |
| 6,098,552 | A | 8/2000 | Gunderson | |
| 6,370,741 | B1 * | 4/2002 | Lu | 24/569 |
| 6,439,134 | B1 | 8/2002 | Ryburg | |
| 6,513,566 | B2 * | 2/2003 | Larin | 160/351 |
| 6,546,879 | B1 | 4/2003 | Johnston | |
| 6,736,073 | B2 | 5/2004 | Ryburg | |
| 6,931,998 | B1 * | 8/2005 | Leese | 108/42 |
| 6,984,066 | B2 | 1/2006 | Borom | |
| 7,121,213 | B2 | 10/2006 | Viazanko et al. | |
| 7,210,414 | B1 | 5/2007 | Barone | |
| 7,421,958 | B2 * | 9/2008 | Ciulla | 108/44 |
| 7,533,618 | B2 | 5/2009 | Thomason | |
| 7,966,948 | B1 * | 6/2011 | Galietti | 108/42 |
| 2005/0204521 | A1 * | 9/2005 | Hughto-Delzer et al. | 24/569 |
| 2012/0047711 | A1 * | 3/2012 | Meyer | 29/525.01 |
| 2012/0074282 | A1 * | 3/2012 | Willey | 248/226.11 |

* cited by examiner

*Primary Examiner* — Jose V. Chen
(74) *Attorney, Agent, or Firm* — Boyle Fredrickson S.C.

(57) ABSTRACT

A deck table is provided that includes a table section and a clamping mechanism that are attachable to a number of vertical posts in order to position the support surface on the posts in a horizontal position. The table section includes support surface and a bottom support that can be positioned against the posts and engaged by the clamping mechanism that extends between the posts. The clamping mechanism is rotatably attached to the table section and can be releasably engaged with the vertical posts to enable the table to be readily repositioned and/or removed from the posts, as desired, without disassembly of the component parts of the table.

11 Claims, 5 Drawing Sheets

DECK LEDGE TABLE

CROSS-REFERENCE TO RELATED APPLICATIONS

This application claims priority from U.S. Provisional Application Ser. No. 61/524,837, filed on Aug. 18, 2011, the entirety of which is hereby expressly incorporated by reference herein.

FIELD OF THE DISCLOSURE

The present invention relates generally to a support surface in the form of a table, and more particularly to a table adapted for use on a deck.

BACKGROUND OF THE DISCLOSURE

There are many types of tables and other support surfaces that are used to hold objects at desired positions and locations. The vast majority of these tables are free-standing, in that the tables are supported by legs or other support members extending downwardly from the table top into contact with a floor or other surface to hold the table top at the desired location.

However, in certain environments there is a limited amount of space on a surface upon which to support a table. In these environments, tables have been developed that minimize the area of the surface necessary for supporting the table. In the designs for these tables, the table includes legs or similar support members disposed on one side of the table that engage the surface over which the table is positioned. Opposite the legs, the table includes a mechanism that enables the table to be engaged with a non-horizontal support surface in order to position the table where desired.

However, one main drawback for these types of tables adapted for use with a non-horizontal support surface is that the engagement mechanism holding the table on the non-horizontal support surface must be disassembled and/or removed from the table in order relocate the table from one location to another.

Also, in many situations there is a limited amount of surface area available on which tables, chairs and other items can be positioned. Therefore, in these situations where surface area is limited, it is desirable to develop a table that can be positioned at the desired location by attaching the table to another structure near the floor or other surface, while not obscuring any part of the surface over which the table is positioned with legs or similar vertical support members.

Furthermore, it is desirable to develop a table which can be moved from one location to another without requiring the disassembly of the table's members.

SUMMARY OF THE DISCLOSURE

Briefly described, one aspect of the present disclosure provides a table that includes a clamping mechanism that enables the table to be releasably secured to vertical structural members, such as the slats of a deck ledge or rail. The table includes a table section support surface or table top including a bottom support affixed to the bottom surface of the table top. The table section is engaged with a clamping assembly. The clamping assembly operates to engage the table with the vertical structural members, and includes a screw that can be moved into and out of the table section by rotating the screw with regard to the table section. When moved into the table section, a back clamp secured to the screw opposite the table section is moved towards the table section, such that any structure positioned between the table section and the back clamp is frictionally engaged therebetween.

According to another aspect of the present disclosure, a biasing member is positioned around the screw between the back clamp and the table section. The biasing member provides a force against the movement of the back clamp towards the table section that aids in disengagement of the back clamp and table section from the vertical structure(s), easing the removal of the table.

According to still another aspect of the present invention, the back clamp is rotatably attached to the screw, such that the back clamp can rotate with respect to the screw and table section. In this construction, the back clamp can be rotated to be aligned with the spaces between the vertical members to which the back clamp can be secured. Thus, the back clamp can remain attached to the table section via the screw when being secured or unsecured from the vertical members allowing for attachment of the table by a single individual.

Numerous other aspects, features, and advantages of the present invention will be made apparent from the following detailed description together with the drawings figures.

BRIEF DESCRIPTION OF THE DRAWINGS

The drawings illustrate the best mode currently contemplated of practicing the present disclosure.

In the drawings.

DETAILED DESCRIPTION OF THE DISCLOSURE

Figure 1:
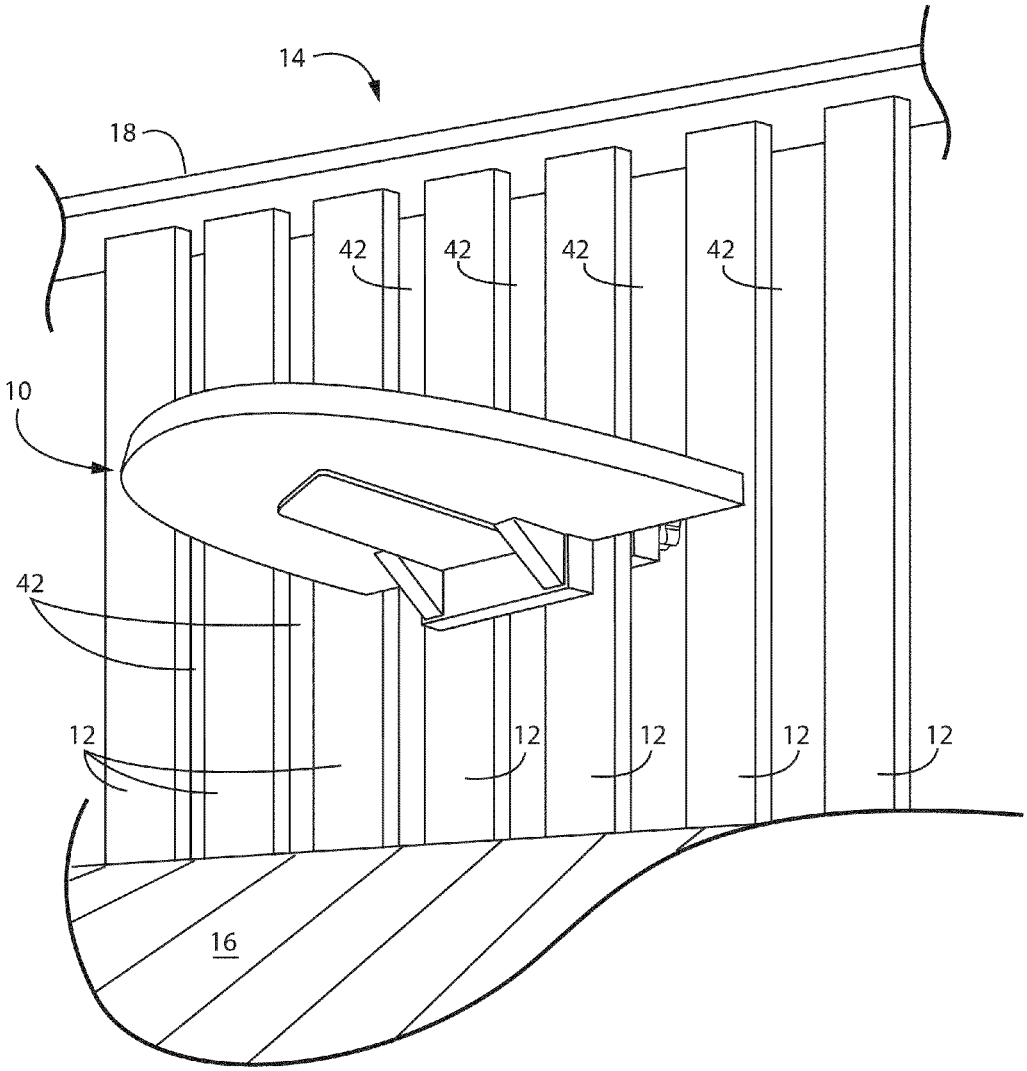
FIG. 1 is a perspective view of a table constructed according to the present disclosure.
Figure 2:
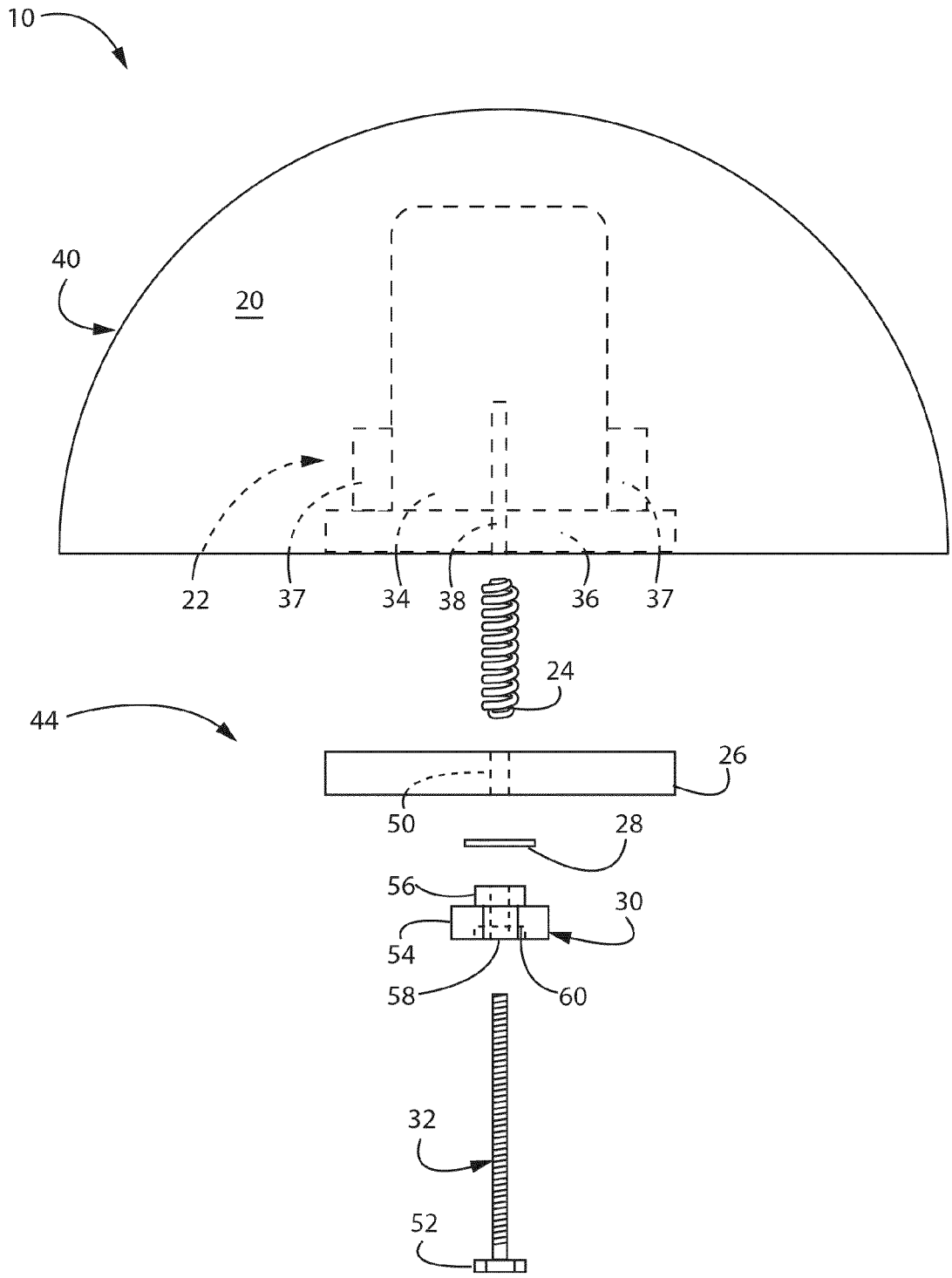
FIG. 2 is an exploded top plan view of the table of FIG. 1.
Figure 3:
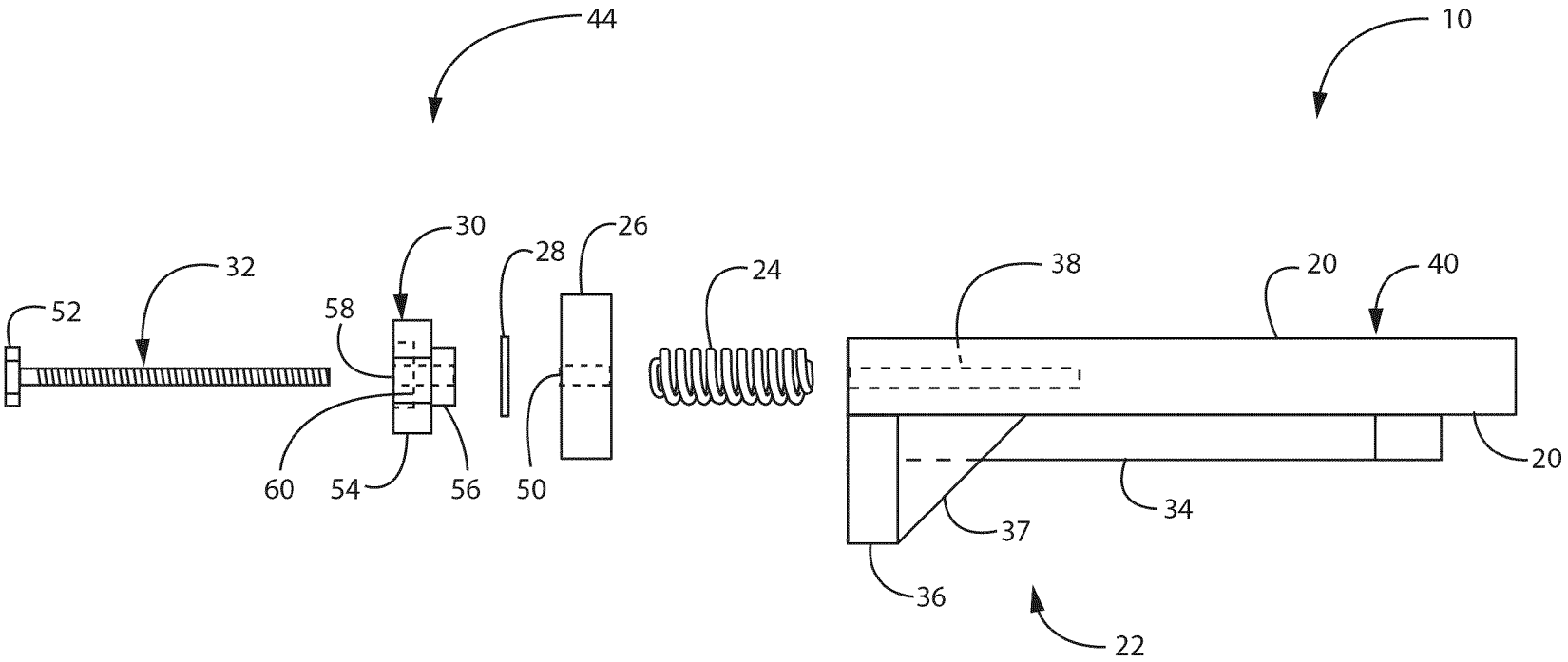
FIG. 3 is an exploded side plan view of the table of FIG. 1.
Figure 4:
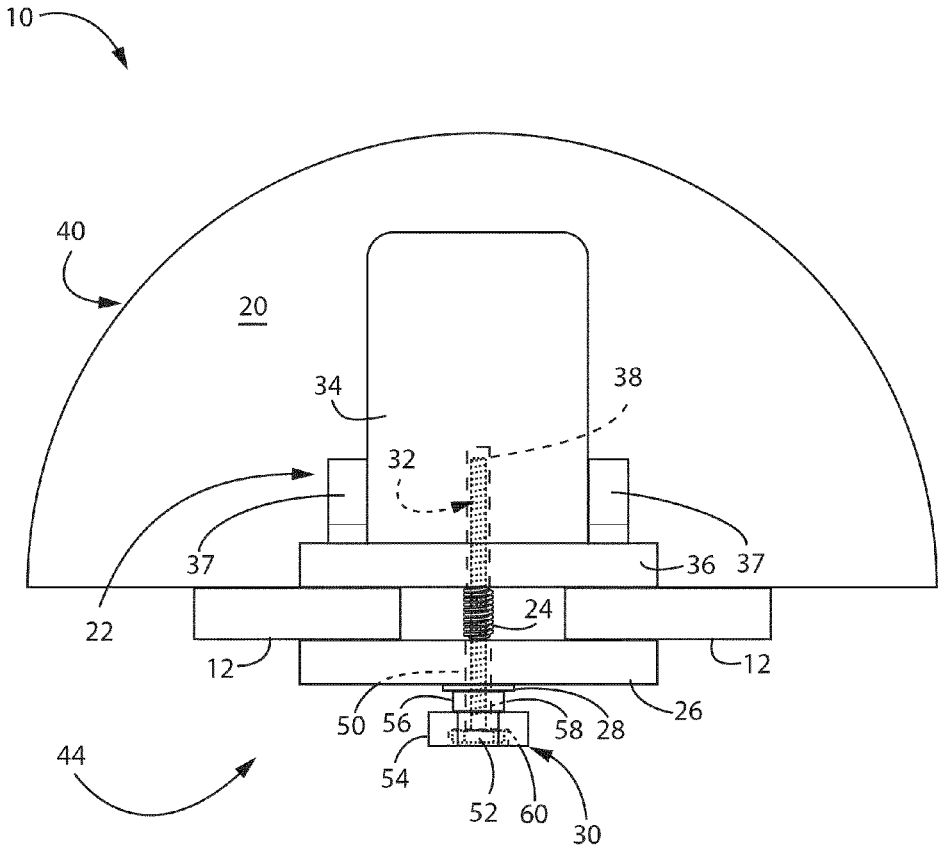
FIG. 4 is a bottom plan view of the table of FIG. 1 in an engaged position.
Figure 5:
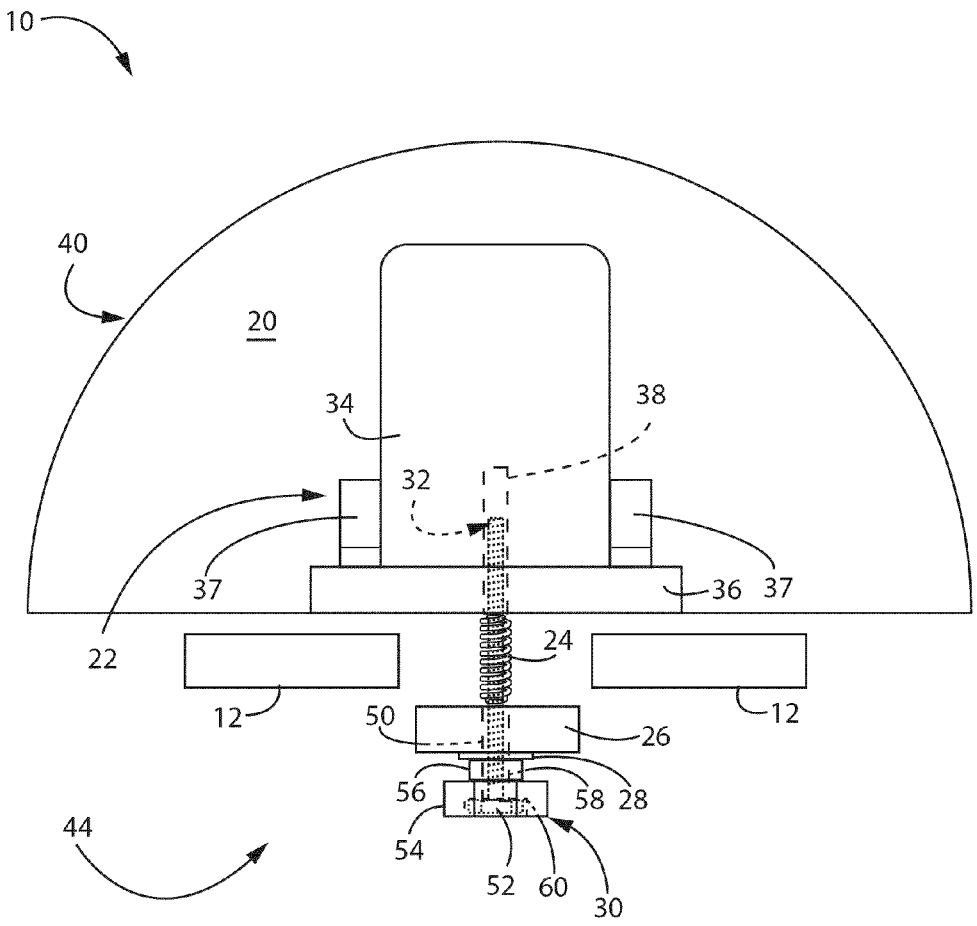
FIG. 5 is a bottom plan view of the table of FIG. 1 in a disengaged position.

Referring now in detail to the drawing figures, wherein like reference numerals represent like parts throughout the several views, one embodiment of a table constructed according to the present disclosure is illustrated generally at 10 in FIG. 1. The table 10 is secured to at least one, and preferably two or more vertical posts 12, such as those forming a part of a ledge or railing 14 positioned around the periphery of a deck 16. The posts 12 are connected to one another at the bottom end by the deck 16 and at the top end by a hand rail 18.

Referring now to FIGS. 2-5, the table 10 includes a table section 40, comprised of a support surface 20 and a bottom support 22. The table portion 40 can be formed of any suitable material, such as a plastic, wood or metal. The bottom support 22 includes a flat portion 34 secured to the support surface 20 and a projecting portion 36 attached to the flat portion 34 and extending downwardly from the support surface 20. The bottom support 22 can also include braces 37 connected between the projecting portion 36 and the support surface 20 to provide additional strength and rigidity to the table section 40.

The projecting portion 36 and flat portion 34 define a channel 38 therein for receiving and engaging a fastener 32 forming a part of a clamping assembly 44. In an alternative embodiment, the channel 38 can also be formed in the support surface 20. The channel 38 includes a configuration that enables the fastener 32 to be engaged and held within the channel 38. In one embodiment the channel 38 is internally threaded (not shown) in order to engage exterior threads on the fastener 32, which holds the fastener 32 in engagement with the table portion 40. The internal surface of the channel 38 may also include a separate structure, such as a cylindrical threaded insert (not shown), that provides the surface for engagement with the fastener 32.

Also, referring to FIGS. 2-5, the clamping assembly 44 in the illustrated embodiment is comprised of a spring or biasing member 24, a back clamp 26, a washer 28, a knob 30, as well as the fastener 32. The back clamp 26 can be formed from any suitable material, such as a plastic, wood or metal, which can also be selected a material similar to the material used for the table section 40. The back clamp 26 can optionally be formed with a suitable cushioning material (not shown) on one surface of the clamp 26. The material can be positioned against the vertical posts 12 in order to minimize any damage to the clamp 26 or the posts 12. Additionally, the cushioning material can also optionally be positioned on the table portion 40 in order to protect the table portion 40 and the posts 12 opposite the clamp 26.

The back clamp 26 is mounted to the fastener 32 through an aperture 50 extending through the back clamp 26, such that the back clamp 26 can rotate freely with regard to the fastener 32. The fastener 32 includes a head 52 disposed opposite the table portion 40 that has a diameter larger than the aperture 52 in order to prevent the back clamp 26 from coming off of the fastener 32.

To assist in holding the back clamp 26 on the fastener 32, and to assist in the rotation of the fastener 32 with regard to the table section 40, the knob 30 is disposed on the head 52 of the fastener 32. The knob 30 can be formed with any suitable shape and of any suitable material, and includes a grasping portion 54 and a collar 56 disposed concentrically on and extending outwardly from the grasping portion 54. Both the grasping portion 54 and the collar 56 define a central passage 58 through which the fastener 32 can extend. The grasping portion 54 also includes a recess 60 opposite the collar 56 that is shaped complementary to the head 52 of the fastener 32. Thus, when the fastener 32 is fully inserted through the passage 58, the head 52 nests within and is engaged by the recess 60. In this manner, when the grasping portion 54 is grasped to turn the knob 30, the turning of the knob 30 also turns the fastener 32 as a result of the engagement between the head 52 and the recess 60.

The rotation of the knob 30 with respect to the back clamp 26 is facilitated by the presence of the washer 28 around the fastener 32 between the collar 56 of the knob 30 and the back clamp 26. The washer 28 reduces the friction between the knob 30 and the clamp 26, enabling the clamp 26 and knob 30 to rotate relatively freely with respect to one another to engage or disengage the clamp 26 from the vertical posts 12.

To assist in the disengagement of the clamp 26 from the posts 12 when desired, the clamping assembly 44 also includes the biasing member 24. The biasing member 24 in the illustrated embodiment is formed as a helical coil spring defining an opening through which the fastener 32 extends, though other suitable biasing members can also be utilized, such as Bellville springs or a compressible foam material, among others which can also be attached to one or both of the back clamp 26 and the table section 40 separate from the fastener 32. The biasing force of the biasing member 24 presses the clamp 26 away from the table section 40, thereby aiding an individual in releasing the clamp 26. In the illustrated embodiment, the diameter of the biasing member 24 is selected such that the diameter of the biasing member 24 is greater than the diameter of the channel 38, thereby preventing the biasing member 24 from entering the channel 38. However, depending upon the particular structure or configuration for the biasing member 24, the biasing member 24 can be disposed partially within the channel 38.

In use, to secure the table 10 to the vertical posts 12, initially the knob 30 and fastener 32 are rotated to move the back clamp 26 away from the table section 40 to a position where the clamp 26 can move with respect to the knob 30 and fastener 32. The clamp 26 is rotated into a vertical orientation where the clamp 26 can be moved through the gap 42 formed between adjacent vertical posts 12. The clamp 26 is subsequently moved between adjacent posts 12 through the gap 42. The table section 40 and clamp 26 are then positioned at the desired height within the gap 42. The back clamp 26 is then rotated ninety (90) degrees to a horizontal orientation in order to position the clamp 26 over one or more of the vertical posts 12.

When the table section 40 and clamp 26 are positioned where desired, the knob 30 is grasped and turned in order to move the fastener 32 into the channel 38. This consequently draws the clamp 26 towards the table section 40 against the bias of the biasing member 24, such that the clamp 26 and table section 40 frictionally engage the vertical posts 12. The knob 30 is continued to be turned until the clamp 26 and table section 40 are sufficiently engaged with the vertical posts 12 to hold the table 10 where desired.

Further, as the fastener 32 is engaged within the channel 38 in the table section 40, the fastener 32 compresses the biasing member 24. The bias of the spring 24 acts against the back clamp 26, such that when it is desired to remove the table 10, the bias of the spring 24 assists in urging the back clamp 26 away from the vertical posts 12. However, the bias of the spring 24 is not sufficient to move the fastener 32 out of the channel 38 without the corresponding movement of the fastener 32, which can be actuated by pressing and turning knob 30, to maintain the table 10 in engagement with the railing 14 or to release the table 10 from engagement with the railing 14.

The table 10 is secured to the rail 16 by the frictional engagement of the back clamp 26 and the back areas of table section 40 with opposite sides of the vertical posts 12. To reposition the table 10 within the gap 42, the fastener 32, which can be moved in relation to the table section 40 by pressing and turning the knob 30, is simply moved away from the table section 40, consequently moving the back clamp 26 away from the posts 12. The table 10 can then be slid vertically along the posts 12 and within the gap 42 and the fastener 32 moved back toward the table section 40, until frictional engagement with table 10 and the vertical posts 12 is accomplished. Furthermore, the table 10 can be removed by moving fastener 32 away from table section 40, rotating the back clamp 26 to a vertical position and removing the entire, intact, table 10 from the vertical posts 12. The table 10 can then be relocated to a desired location between any suitable vertical posts 12.

Various other embodiments of the present invention are contemplated as being within the scope of the filed claims particularly pointing out and distinctly claiming the subject matter regarded as the invention.

The invention claimed is:

1. A table adapted to be secured to one or more vertical members, the table comprising:

a) a support surface including a bottom support disposed on a lower surface of the support surface; and b) a clamp mechanism rotatably engaged with the bottom support to clamp one or more vertical members therebetween in order to position the support surface on the vertical members, wherein the clamp mechanism remains completely intact and rotatably engaged with the bottom support when removing the support surface from the one or more vertical members, wherein the clamp mechanism includes:

i) a back clamp; and ii) a fastener connected to the back clamp and rotatably engaged with the bottom support to selectively engage an engagement surface on the back clamp with the one or more vertical members to hold the table in a desired position with respect to the vertical members, wherein the fastener defines a first axis and wherein the back clamp is rotatable around the first axis between a horizontal position where the back clamp is positioned to engage the vertical members and a vertical position where the back clamp is positioned to pass between the vertical members.

2. The table of claim 1 wherein the clamp mechanism includes a biasing member disposed between the support surface and the back clamp.

3. The table of claim 2 wherein the fastener extends through an opening in the biasing member.

4. The table of claim 3 wherein the knob includes a recess within which is disposed a head of the fastener.

5. The table of claim 1 wherein the fastener extends through an aperture in the back clamp.

6. The table of claim 5 further comprising a knob engaged with the fastener opposite the bottom support.

7. The table of claim 1 wherein the fastener is engaged at least partially within a channel formed in the bottom support.

8. The table of claim 7 wherein the fastener includes an external thread and the channel has an internal thread engaged by the external thread of the fastener.

9. A method of positioning a table on a number of vertical members in a horizontal position, the method comprising the steps of:

a) providing a the table of claim 1;

b) positioning the table against the vertical members; and c) engaging the clamp mechanism to engage the vertical members between the clamp mechanism and the bottom support of the support surface.

10. The method of claim 9 wherein the clamp mechanism includes a back clamp and a fastener connected to the back clamp and rotatably engaged with the bottom support, and wherein the step of engaging the clamp mechanism comprises rotating the fastener with respect to the bottom support to draw the back clamp towards the bottom support.

11. The method of claim 10 further comprising the step of disengaging the table from the vertical members as an assembled unit in order to move the table to a separate location.

* * * * *